US008387701B2

(12) United States Patent
Sbordone

(10) Patent No.: US 8,387,701 B2
(45) Date of Patent: Mar. 5, 2013

(54) INTERVENTION SYSTEM DYNAMIC SEAL AND COMPLIANT GUIDE

(75) Inventor: Andrea Sbordone, Rio de Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 451 days.

(21) Appl. No.: 12/532,661

(22) PCT Filed: Apr. 3, 2008

(86) PCT No.: PCT/EP2008/054043

§ 371 (c)(1),
(2), (4) Date: Jan. 28, 2010

(87) PCT Pub. No.: WO2008/122577

PCT Pub. Date: Oct. 16, 2008

(65) Prior Publication Data

US 2010/0163243 A1 Jul. 1, 2010

Related U.S. Application Data

(60) Provisional application No. 60/910,313, filed on Apr. 5, 2007.

(30) Foreign Application Priority Data

Jan. 22, 2008 (GB) ..... 0801124.9

(51) Int. Cl.
*E21B 33/035* (2006.01)

(52) U.S. Cl. ..... 166/338; 166/339; 166/352; 166/368; 166/387; 166/85.3; 277/323

(58) Field of Classification Search ..... 166/338, 166/339, 344–346, 351, 352, 367, 368, 378, 166/381, 385, 387, 77.1, 77.2, 85.1, 85.3, 166/241.5; 405/183.5, 224.2–224.4; 277/322, 277/323, 343
See application file for complete search history.

(56) References Cited

U.S. PATENT DOCUMENTS

| | | | | |
|---|---|---|---|---|
| 3,556,209 | A * | 1/1971 | Reistle et al. | 166/352 |
| 3,621,912 | A * | 11/1971 | Wooddy et al. | 166/340 |
| 4,577,687 | A * | 3/1986 | Lanmon, II | 166/243 |
| 4,905,763 | A * | 3/1990 | Sauer et al. | 166/336 |
| 4,951,745 | A * | 8/1990 | Gentry et al. | 166/84.2 |
| 6,244,359 | B1 * | 6/2001 | Bridges et al. | 175/5 |
| 6,321,846 | B1 * | 11/2001 | Rytlewski | 166/363 |
| 6,386,290 | B1 * | 5/2002 | Headworth | 166/346 |
| 6,457,529 | B2 * | 10/2002 | Calder et al. | 166/368 |

(Continued)

FOREIGN PATENT DOCUMENTS

| | | |
|---|---|---|
| GB | 2297105 | 7/1996 |
| GB | 2359106 | 8/2001 |

(Continued)

OTHER PUBLICATIONS

GB Examination Report dated Jan. 31, 2012 for corresponding GB Application No. 0801124.9 (69.5721 GB NP).

*Primary Examiner* — Matthew Buck
(74) *Attorney, Agent, or Firm* — Matthias Abrell

(57) ABSTRACT

A technique for subsea intervention operations utilizes a retrievable dynamic seal assembly. The retrievable dynamic seal assembly is deployed toward a seabed and locked into place within a tubular member at a subsea installation. During deployment, the dynamic seal assembly is releasably locked to an intervention tool string coupled to a conveyance. Once the dynamic seal assembly is locked in place within the tubular, the tool string is released and the dynamic seal assembly maintains a seal against the conveyance during an intervention operation.

8 Claims, 9 Drawing Sheets

U.S. PATENT DOCUMENTS

| | | | | |
|---|---|---|---|---|
| 6,691,775 | B2 * | 2/2004 | Headworth | 166/77.2 |
| 6,834,724 | B2 * | 12/2004 | Headworth | 166/384 |
| 6,843,321 | B2 * | 1/2005 | Carlsen | 166/355 |
| 7,165,610 | B2 * | 1/2007 | Hopper | 166/84.4 |
| 7,389,818 | B2 * | 6/2008 | Hoiland | 166/367 |
| 7,431,092 | B2 * | 10/2008 | Haheim et al. | 166/343 |
| 7,845,412 | B2 * | 12/2010 | Sbordone et al. | 166/368 |
| 2008/0245528 | A1 * | 10/2008 | Stokka et al. | 166/357 |
| 2009/0166046 | A1 * | 7/2009 | Edvardson et al. | 166/387 |

FOREIGN PATENT DOCUMENTS

| | | | |
|---|---|---|---|
| GB | 2446496 | | 8/2008 |
| WO | WO 00/43632 | | 7/2000 |
| WO | WO 01/61145 | | 8/2001 |
| WO | 2007008085 | | 1/2007 |
| WO | 2007032687 | A1 | 3/2007 |
| WO | 2007103707 | A2 | 9/2007 |

* cited by examiner

INTERVENTION SYSTEM DYNAMIC SEAL AND COMPLIANT GUIDE

BACKGROUND

The retrieval of desired fluids, such as hydrocarbon based fluids, is pursued in subsea environments. Production and transfer of fluids from subsea wells relies on subsea installations, subsea flow lines and other equipment. Additionally, preparation and servicing of the subsea well relies on the ability to conduct subsea intervention work. A big challenge in subsea intervention work is controlling pressure so that pressurized borehole fluids in the subsea well are contained within the borehole during intervention operations. Subsea intervention work involves numerous challenges not normally faced when working on land wells or offshore platforms. In most cases, intervention in subsea wells is performed from a floating platform or ship by extending the borehole to a surface location by a tensioned riser. This approach allows pressurized borehole fluids to move upwardly to the surface through the riser which can span hundreds or thousands of feet of sea water. The cost of such platforms is high, however, and the availability of vessels capable of adequately performing this type of intervention work is limited.

In shallow waters, subsea intervention work can be performed with a specially equipped vessel having subsea lubricators, subsea pressure control equipment, and wave motion compensating systems. In most cases, guide wires extending from a wellhead all the way to the vessel combined with the aid of professional divers is required. Additionally, this approach requires that equipment is conveyed and guided from the vessel to the subsea installation through open waters. Once the subsea lubricator is connected to the subsea installation and the tools are inside, the conveyance cable remains exposed to open waters. Additionally, pressure control must be exercised at the seabed. Because existing non-rig intervention capability is limited to shallow water wireline and slickline operations, most intervention on subsea wells is currently performed with expensive and scarce heavy drilling units.

When exercising pressure control, borehole fluids are kept separated by seals formed during certain well servicing operations. In U.S. Pat. No. 4,905,763, for example, separation of borehole fluids is maintained during logging operations by a sealing nipple and a stuffing box assembly. The assembly is lowered down through a riser extending between a platform and a blowout preventer stack. In another application described in U.S. Pat. No. 4,951,745, a hydraulically actuated stuffing box is mounted on top of an underwater lubricator assembly to seal against a line during well service operations.

SUMMARY

In general, the present invention provides a technique for subsea intervention operations which utilizes a dynamic seal assembly. The dynamic seal assembly is deployed toward a seabed and locked into place within a tubular member at a subsea installation. During deployment, the subsea seal assembly is releasably locked to an intervention tool string coupled to a conveyance. Once the dynamic seal assembly is locked in place within the tubular, the tool string is released and the dynamic seal assembly maintains a seal against the conveyance. Preferably, the tool string and dynamic seal are deployed through a compliant guide that extends between a surface location and the subsea installation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for intervening in subsea installations, such as subsea wells. The technique also provides unique ways of utilizing an intervention system having a compliant guide, such as a spoolable compliant guide, and a dynamic seal to facilitate intervention operations with a variety of tool strings. For example, a retrievable, dynamic seal can be conveyed through the compliant guide to provide a requisite dynamic seal at a subsea location. Furthermore, the dynamic seal may be designed as an auto-locking seal that is easily locked into position at the desired subsea location either within the compliant guide or proximate the compliant guide at a subsea installation.

The dynamic seal can be used to accommodate movement of a conveyance therethrough. For example, a wireline, slickline, coiled tubing, coiled rod or other appropriate conveyance can move through the interior of the compliant guide and through the dynamic seal. The dynamic seal effectively seals against the conveyance once locked in place at the desired subsea location.

As described in greater detail below, the intervention system enables easy deployment and retrieval of the dynamic seal through the compliant guide. Additionally, a dynamic seal force can be applied between the dynamic seal and the conveyance by controlling the differential pressure above and below the dynamic seal assembly. The differential pressure can be controlled from the surface, and the squeezing force resulting from the differential pressure can be adjusted by appropriately dimensioning the areas exposed to pressure above and/or below the dynamic seal assembly. Alternatively, the sealing force can be controlled through a separate mechanism, such as a hydraulically activated mechanism controlled via a dedicated hydraulic control line. This type of alternate system can be used, for example, if the intervention application gives rise to a need for separate control over the differential pressure and the squeezing force exerted by the dynamic seal against the conveyance.

Figure 1:
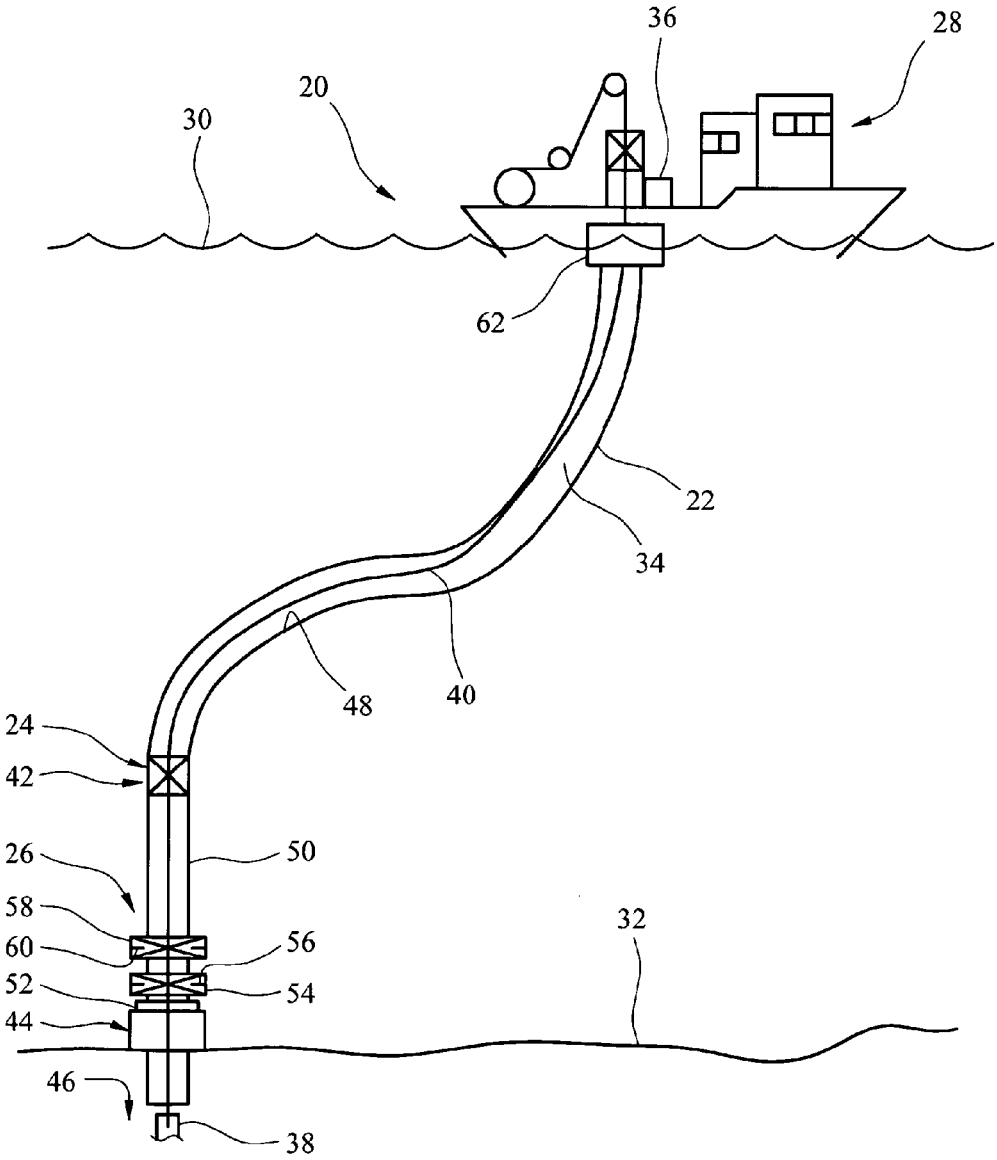
FIG. 1 is a schematic front elevation view of a subsea intervention system, according to an embodiment of the present invention.

Referring generally to FIG. 1, an intervention system 20 is illustrated according to an embodiment of the present invention. In this embodiment, system 20 comprises a compliant guide 22, e.g a spoolable compliant guide, and a dynamic seal assembly 24, which also can be referred to as a dynamic stuffing box. Compliant guide 22 is coupled between a subsea installation 26 and a surface vessel 28, such as an intervention vessel located at a surface 30 of the sea. Subsea installation 26 may be located on or at a seabed floor 32. The pressure in the compliant guide 22 can be selectively adjusted to assist intervention operations involving, for example, pulling out of the well or running into the well.

Compliant guide 22 is flexible, and dynamic seal assembly 24 is sized for deployment and retrieval along the interior of compliant guide 22. Depending on the specific intervention application, compliant guide 22 may be arranged in a variety of curvilinear shapes extending between a surface location, e.g. intervention vessel 28, and subsea installation 26. Compliant guide 22 also may be constructed as a tubular member formed from a variety of materials that are sufficiently flexible, including metal materials of appropriate cross-section and composite materials. A compliant guide and a system for accessing subsea well using said compliant guide and coiled tubing is described and claimed to U.S. Pat. No. 6,691,775 B2, U.S. Pat. No. 6,386,290 B1 and U.S. Pat. No. 6,834,724 B2 of Collin Stuart Headworth, all assigned to the same assignee as the present invention and which are incorporated herein by reference for all purposes.

To control the pressure differential acting on dynamic seal assembly 24, compliant guide 22 may be filled with a buffer fluid 34, such as seawater, introduced into the interior of compliant guide 22. In some applications, other buffer fluids 34 can be used, e.g. environmentally friendly greases for friction reduction or for pressure sealing; fluids designed for hydrate prevention; weighted mud; and other appropriate buffer fluids. The level and pressure of buffer fluid 34 can be controlled from the surface by, for example, standard hydraulic pressure control equipment 36 that may be mounted on intervention vessel 28.

Once compliant guide 22 is coupled between subsea installation 26 and intervention vessel 28, the dynamic seal assembly 24 may be run down through compliant guide 22 with an intervention tool string 38. The intervention tool string 38 is deployed by a conveyance 40, and dynamic seal assembly 24 is coupled to conveyance 40 for movement to a desired subsea location 42. The dynamic seal assembly 24 is coupled to conveyance 40 until locked into position at the desired subsea location 42. Subsequently, the dynamic seal assembly 24 is released from conveyance 40 but remains sealed against conveyance 40 as the conveyance is moved to deploy and/or retrieve intervention tool string 38. In some applications, the conveyance of dynamic seal assembly 24 down through compliant guide 22 can be assisted by pumping a fluid into the compliant guide so the pumped fluid pushes the dynamic seal down through the compliant guide. A port can be provided at the bottom of the compliant guide for expulsion of displaced fluid. The retrieval of dynamic seal assembly 24 also can be assisted by pumping fluid out of the compliant guide from the surface. In this latter case, fluid can enter through the port and apply hydrostatic pressure against the bottom of the dynamic seal assembly 24. The maximum force applied against the dynamic seal assembly can be controlled by setting a limit on the pressure of the fluid pumped at the surface with hydraulic pressure control equipment 36, for example.

The dynamic seal assembly 24 and compliant guide 22 can accommodate many different types of conveyances 40. For example, conveyance 40 may be a flexible, cable-type conveyance, such as a wireline or slickline. However conveyance 40 also may comprise stiffer mechanisms including coiled tubing and coiled rod. When a cable-type conveyance 40 is used to convey intervention tool string 38, compliant guide 22 can be arranged to facilitate passage of the intervention tool string 38, in some applications, without requiring a pushing force. In other words, the curvilinear configuration of compliant guide 22 is readily adjustable via, for example, locating intervention vessel 28 so as to avoid bends or deviated sections that could interfere with the passage of intervention tool string 38. Thus, in addition to enabling pressure control within the compliant guide 22, the flexibility of compliant guide 22 enables its configuration to be adjusted as necessary by simply moving intervention vessel 28. Dynamic changes can temporarily be made to compliant guide 22 to change the shape of the compliant guide for facilitating the passage of a tool string. By way of further example, the intervention vessel can be turned to orient itself with its bow against the wind, waves, and currents. Furthermore, the desired orientation of the compliant guide may change from one intervention operation to another or during a given intervention operation depending on parameters, such as current, subsea obstacles, surface obstacles and other environmental factors.

Although a variety of subsea installations 26 can be utilized depending on the particular environment and type of intervention operation, one example is illustrated in FIG. 1. In this example, the subsea installation 26 comprises a subsea wellhead 44, which may include a Christmas tree, coupled to a subsea well 46. Dynamic seal assembly 24 may be positioned generally at the bottom of compliant guide 22 to help block incursion of well fluids into an interior 48 of the compliant guide. In other embodiments, dynamic seal 24 may be positioned proximate compliant guide 22 in, for example, subsea installation 26.

In the embodiment illustrated, dynamic seal assembly 24 is generally positioned above a subsea lubricator 50 of subsea installation 26. As illustrated, subsea installation 26 also may comprise a variety of other components. For example, subsea installation 26 comprises a lubricating valve 52 that may be deployed directly above subsea wellhead 44. Lubricating valve 52 can be used to close the borehole of subsea well 46 during certain intervention operations, such as tool change outs. A blowout preventer 54 may be positioned above lubricating valve 52 and may comprise one or more cut-and-seal rams 56 able to cut through the interior of the subsea installation and seal off the subsea installation during an emergency disconnect. The subsea installation 26 also may comprise a second blowout preventer 58 positioned above blowout preventer 54 and comprising one or more sealing rams 60 able to seal against the conveyance 40. Many other components, e.g. an emergency disconnect device 62, also can be incorporated into intervention system 20 depending on the specific intervention application.

In operation, the subsea dynamic seal assembly 24 is designed to prevent the escape of borehole fluids from subsea well 46. This prevents the mixing of the borehole fluids with buffer fluid 34 within compliant guide 22. The dynamic seal assembly 24 seals against conveyance 40, and may be designed to seal against a variety of conveyances, such as those listed above. The dynamic seal assembly 24 also can be designed with an active system that may be controlled to selectively open and close its sealing surfaces to accommodate the passage of larger tools.

Figure 2:
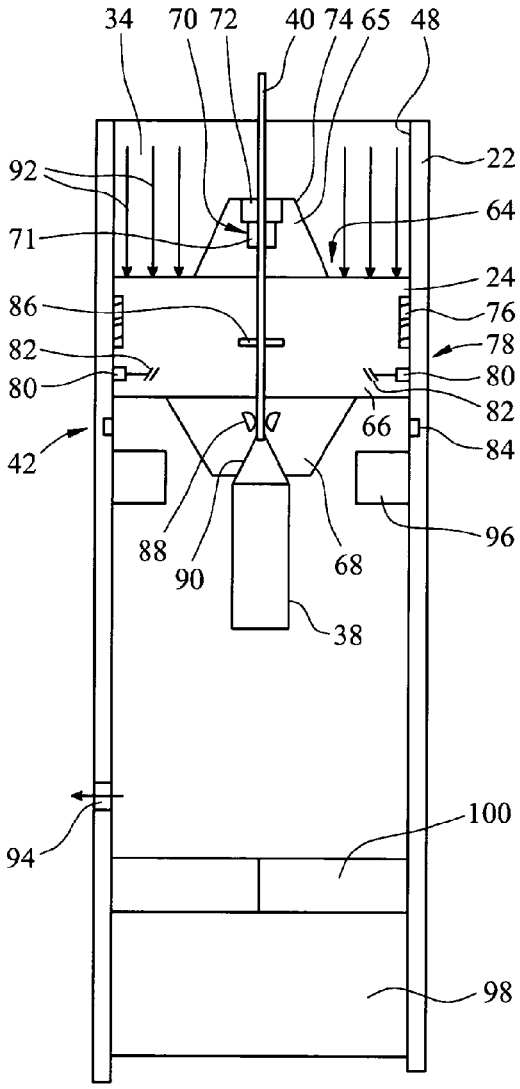
FIG. 2 is a schematic illustration of a portion of the subsea intervention system illustrating a dynamic seal, according to an embodiment of the present invention.

Referring generally to FIG. 2, one embodiment of dynamic seal assembly 24 is illustrated as being deployed down through compliant guide 22. In this embodiment, dynamic seal assembly 24 is illustrated as having a body 64 with an upper region 65, a central region 66 and a lower region 68, however the dynamic seal can be formed in a variety of shapes and configurations. Furthermore, dynamic seal assembly 24 can be formed with a variety of features and components that facilitate its deployment, retrieval and use in the intervention operations. For example, dynamic seal assembly 24 may comprise a dynamic seal 70 having a compressible sealing element 71, e.g. a compressible rubber element, which can be compressed to form a dynamic seal around conveyance 40. Dynamic seal 70 also may comprise a squeezing element 72 may be positioned proximate element 71 to enable selective compression of the sealing element which, in turn, allows control to be excised over the force with which dynamic seal element 71 engages conveyance 40. The squeezing element 72 may be controlled via pressures established in compliant guide 22, differential pressures across dynamic seal 24, by direct hydraulic control via a dedicated control line, or by other appropriate control mechanisms. By way of example, dynamic seal element 71 and squeezing element 72 may be positioned in upper region 65. Upper region 65 also may comprise a fishing neck 74 to allow engagement of a fishing tool if necessary. The upper region 65 also may comprise other elements, such as a differential grease injection system.

Dynamic seal assembly 24 also may comprise a variety of other components, such as an external sealing device 76 that enables formation of a seal between dynamic seal assembly 24 and compliant guide 22, or other surrounding structure, once the dynamic seal 24 reaches its desired subsea location 42. External sealing device 76 may comprise a variety of seal technologies, including swab cups, traveling pigs, and other seal technologies able to form a sufficient seal. The dynamic sealing assembly 24 and external sealing device 76 also can be designed to seal against specifically designed surfaces separate from the internal surfaces of the compliant guide 22.

A locking mechanism 78 is designed to lock dynamic seal assembly 24 in position once it reaches desired subsea location 42. A variety of locking mechanisms can be utilized. However, one embodiment of locking mechanism 78 comprises one or more locking dogs or pins 80 that are spring biased via one or more springs 82 for engagement with corresponding receptacles 84 once dynamic seal 24 reaches desired subsea location 42. The dynamic seal 24 also may be designed with a weak point for releasing the dynamic seal when a predefined differential pressure or pulling force is applied. Additionally, a central sealing device 86 may be provided to automatically seal off the opening through which conveyance 40 normally extends in the event conveyance 40 is removed. In some embodiments sealing device 86 comprises a valve, such as a ball valve. In the illustrated example, sealing device 76, locking mechanism 78 and central sealing device 86 may be generally positioned in central region 66.

Other dynamic seal assembly features may comprise an appropriate attachment mechanism 88 by which dynamic seal assembly 24 is selectively attached to conveyance 40 during deployment and retrieval of the dynamic seal. Attachment mechanism 88 may be a clamping member designed to clamp onto conveyance 40 with sufficient force to secure dynamic seal assembly 24 to the conveyance during transfer. The engagement of attachment mechanism 88 as well as the disengagement of locking mechanism 78 may be initiated mechanically by, for example, movement of intervention tool string 38 into engagement with a tool catcher 90 of dynamic seal assembly 24, as illustrated in FIG. 2. However, a variety of mechanical, hydraulic, electrical or other control mechanisms can be used to engage and disengage both attachment mechanism 88 and locking mechanism 78. By way of example, attachment mechanism 88 may be positioned in lower dynamic seal region 68. However, the position, configuration and arrangement of the dynamic seal components can change depending on the dynamic seal design parameters, environment and intervention operations anticipated.

Figure 3:
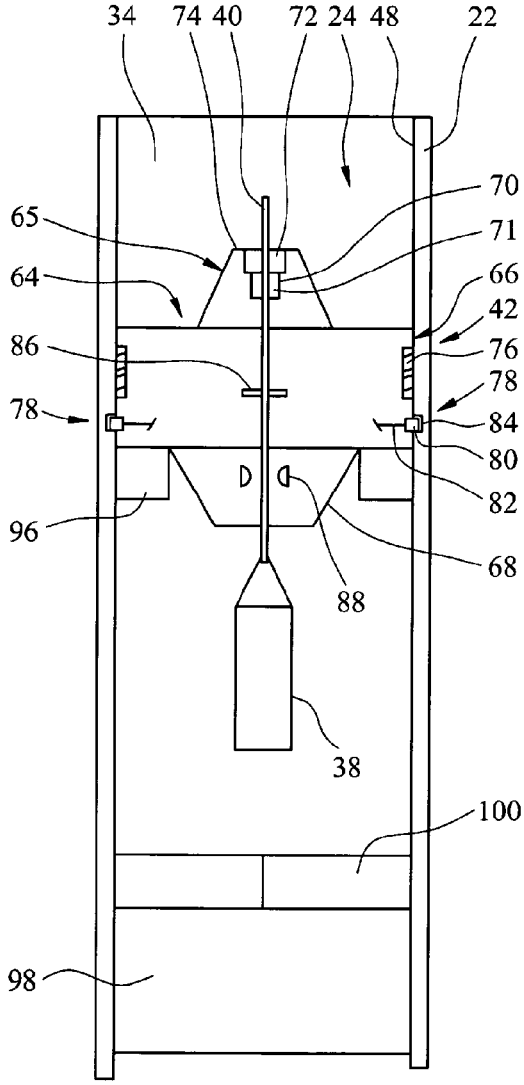
FIG. 3 is a schematic illustration similar to that of FIG. 2 but showing the intervention tool string conveyance released from the dynamic seal, according to an embodiment of the present invention.

In FIG. 2, the dynamic seal assembly 24 is illustrated as attached to conveyance 40 as it is moved down through compliant guide 22 to the desired subsea location 42. Movement of dynamic seal assembly 24 can be aided by pumping a fluid, e.g. water, into compliant guide 22 above dynamic seal assembly 24 and applying downward pressure as indicated by arrows 92. Pumping fluid into compliant guide 22 and applying pressure to an upper side of dynamic seal assembly 24 also can facilitate movement of the dynamic seal assembly 24 through the bends and deviated sections of compliant guide 22. Fluid in the lower dynamic seal assembly 24 can escape through an exit port 94 and is released to the sea, brought back to the surface, or injected into the well. Regardless of whether pressure is applied via fluid above dynamic seal assembly 24, the dynamic seal assembly 24 is ultimately moved to desired subsea location 42 where it is landed on a landing mechanism 96 and locked into position by locking mechanism 78, is best illustrated in FIG. 3.

Once dynamic seal assembly 24 is landed, conveyance 40 is released by releasing attachment mechanism 88. This allows conveyance 40 to move down and/or up with respect to dynamic seal assembly 24. In some embodiments, control over the differential pressure above and below dynamic seal assembly 24 can be used to apply a greater or lesser squeezing force against conveyance 40 via compressible dynamic seal element 71. For example, the pressure of buffer fluid 34 in compliant guide 22 can be increased to activate dynamic seal element 71 via squeezing element 72. When dynamic seal 70 of dynamic seal assembly 24 is appropriately activated to form a sufficient seal against conveyance 40, the well can be opened and the pressure of the buffer fluid 34 can be substantially equalized with the pressure of borehole fluid 98.

Figure 4:
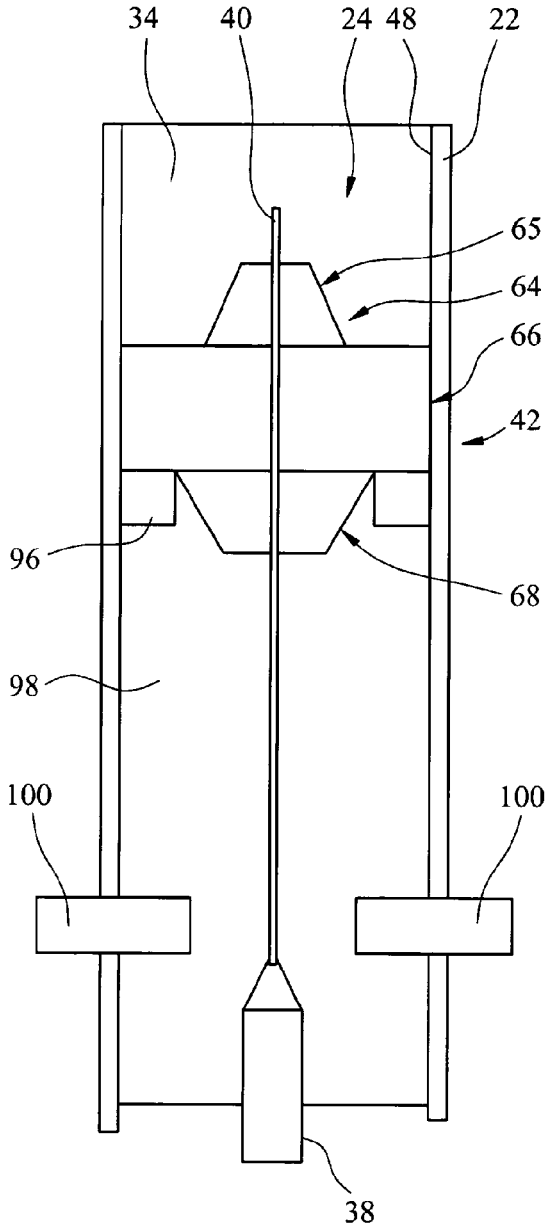
FIG. 4 is a schematic illustration similar to that of FIG. 2 but showing the intervention tool string entering a subsea wellbore, according to an embodiment of the present invention.

When the well is opened, tool string 38 can be deployed into the subsea well 46 for performance of the desired intervention work, as illustrated in FIG. 4. Pressure of the borehole fluid 98 can be monitored from the surface, and the pressure of buffer fluid 34 in compliant guide 22 can be adjusted from the surface via pressure control equipment 36 to maintain the desired differential pressure. The subsea well 46 is opened by opening an appropriate wellbore seal 100 which may be part of existing subsea installation components or combinations of components. For example, the subsea well 46 can be opened for deployment of intervention tool string 38 by opening lubricating valve 52, opening blowout preventer rams, or opening other wellbore seal components or combinations of components.

Figure 5:
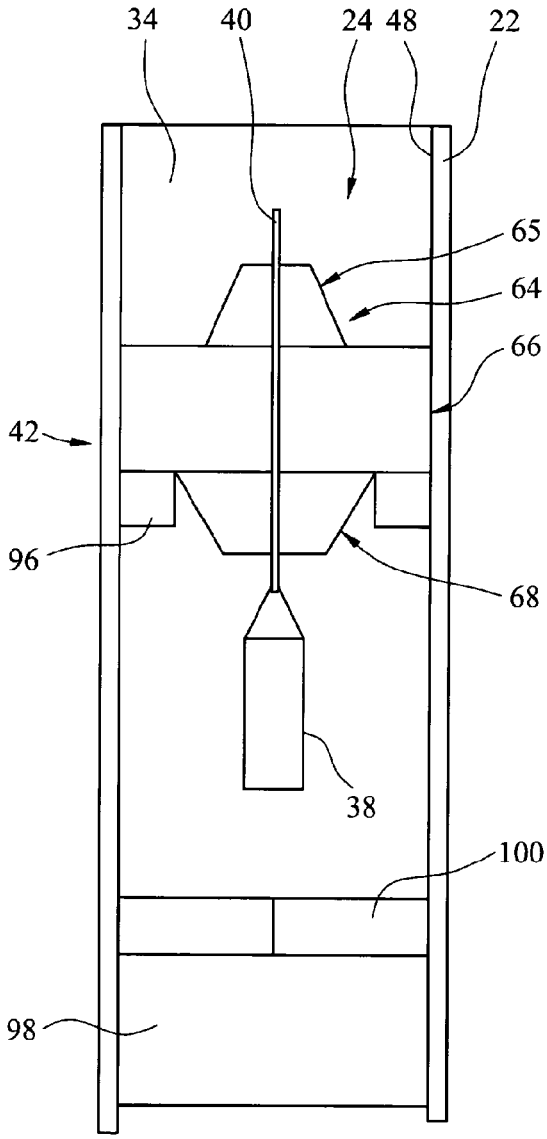
FIG. 5 is a schematic illustration similar to that of FIG. 2 but showing the intervention tool string exiting the subsea wellbore, according to an embodiment of the present invention.
Figure 6:
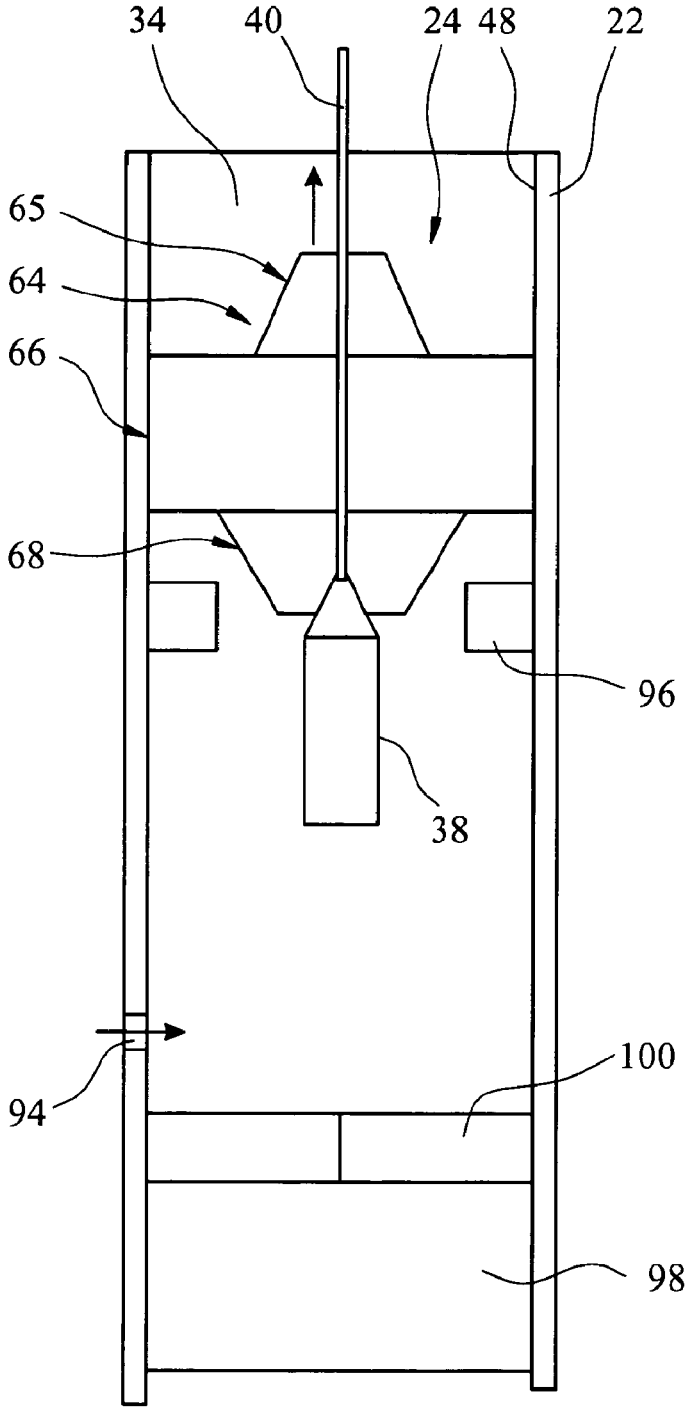
FIG. 6 is a schematic illustration similar to that of FIG. 2 but showing the dynamic seal being retrieved, according to an embodiment of the present invention.

Upon completion of the intervention operation, the intervention tool string 38 is pulled back to a position above wellbore seal 100, as illustrated in FIG. 5. The wellbore seal 100 is then closed to isolate compliant guide 22 from subsea well 46. Borehole fluid may be replaced by clean fluid between dynamic seal assembly 24 and wellbore seal 100. The buffer fluid pressure in compliant guide 22 is then released so that dynamic seal assembly 24 can be retrieved to the surface. Intervention tool string 38 is pulled up against dynamic seal assembly 24 and into engagement with tool catcher 90, as illustrated in FIG. 6. In this embodiment, the top or head of intervention tool string 38 mechanically releases locking mechanism 78 and engages attachment mechanism 88. Conveyance 40 is then pulled upwardly to retrieve dynamic seal assembly 24 and intervention tool string 38 to the surface. In some applications, fluid is pumped from the interior of compliant guide 22, and clean fluid is allowed to enter beneath dynamic seal assembly 24 through a port, such as port 94. While retrieving dynamic seal assembly 24, buffer fluid 34 can be flushed to the surface for recovery and reconditioning if necessary.

The use of compliant guide 22 and transferable dynamic seal assembly 24 facilitates deployment and retrieval of intervention tool string 38. This system and methodology simplifies and increases the efficiency with which intervention tool strings can be interchanged. Additionally, the ability to quickly and efficiently retrieve the tool string enables easy maintenance of the tool strings.

Intervention system 20 also may include or be combined with other components and features. For example, the dynamic seal assembly 24 may comprise an automatic sealing release that can be actuated by, for example, a pre-defined differential pressure to enable fluid to be pumped through the dynamic seal. The system 20 also can be designed to provide a grease injection sealing system having a grease reservoir to enable grease injection under a specified differential pressure. The grease injection system can be designed for use when pressure control is lost at the surface. For example, if pressure in the compliant guide drops and the differential pressure across dynamic seal assembly 24 becomes too great, it may become desirable or necessary to inject grease to maintain the seal. The automatic grease injection can be triggered by, for example, relatively higher pressure above dynamic seal assembly 24, relatively higher pressure below dynamic seal assembly 24, or a specific differential pressure in either direction.

In many applications, the dynamic seal assembly 24 has a fail-safe position in which it is in the closed or sealed configuration. In the case of loss of control, the retrievable dynamic seal assembly 24 is thus able to provide a valid bi-directional pressure barrier sealing around the conveyance. In the fail-safe mode, the dynamic seal assembly 24 is locked in position at the subsea installation, and the dynamic seal element is compressed against conveyance 40 with sufficient force to seal against the maximum potential pressure without preventing movement of the conveyance. An emergency override system also could be incorporated to enable unlocking of the dynamic seal assembly during certain emergencies. Additionally, the dynamic seal assembly may be prevented from releasing when pressure is still present in the subsea lubricator. In at least some applications, well pressure can be used to force the dynamic seal assembly into the locked position even when the intervention tool string is pulled up against the retrievable dynamic seal assembly 24.

The intervention system 20 also may comprise a variety of other features such as a self-orienting locking system. For example, according to an embodiment of the invention the dynamic seal assembly may be specifically oriented or the overall system may be designed so the angular orientation of the dynamic seal assembly is irrelevant to the success of landing and locking the seal assembly in place at the subsea installation. Furthermore, the dynamic seal, e.g. dynamic seal 70, can be actuated via a variety of mechanisms. For example, sets of actuated rams having ramped surfaces can be used to compress a compressible dynamic seal element directly or to act against a cursor slide used to compress the dynamic seal element and thereby form a seal against the conveyance.

Figure 7:
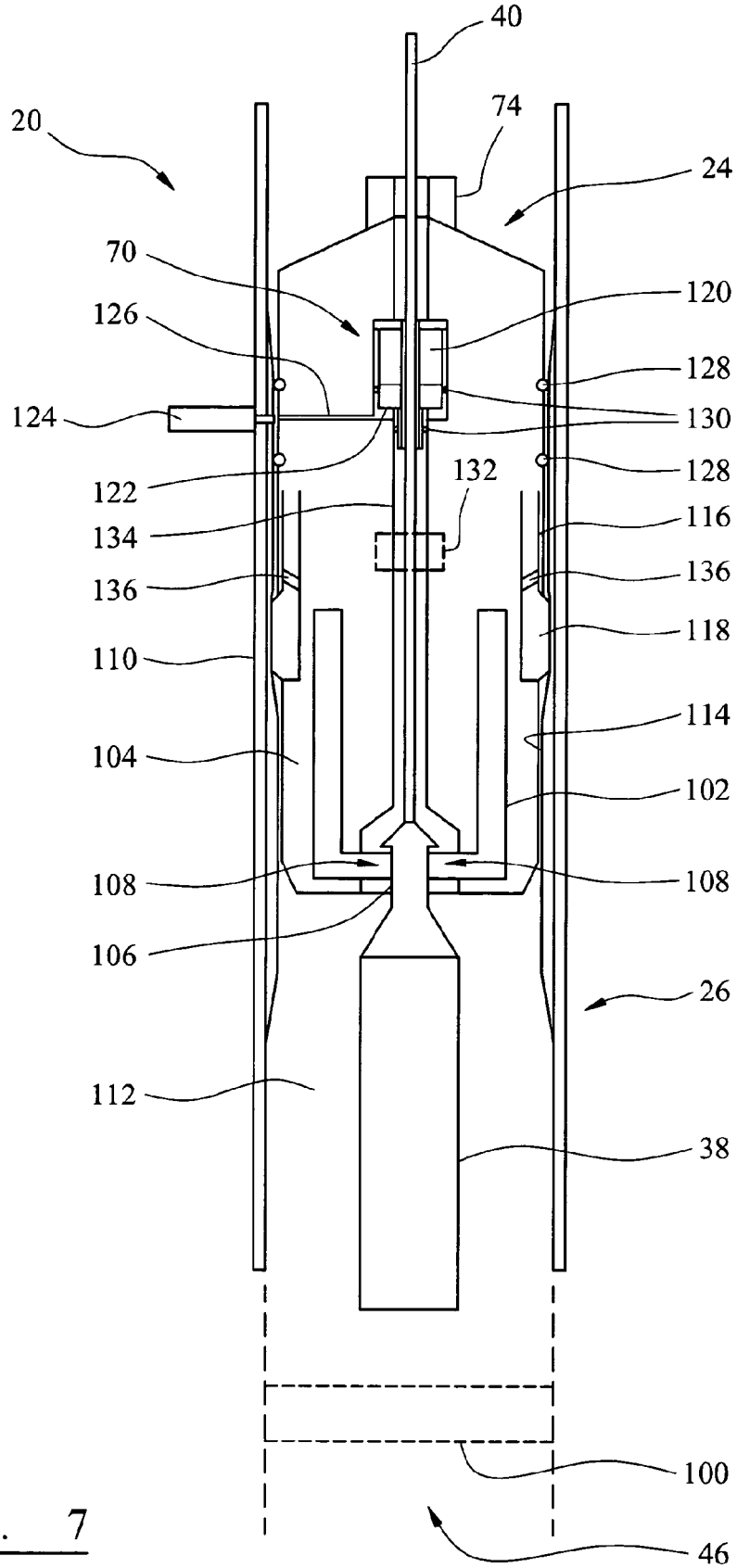
FIG. 7 is a schematic illustration of an alternate example of a retrievable dynamic seal assembly positioned in a tubular structure, according to an alternate embodiment of the present invention.

These and other features can be incorporated into a variety of embodiments of the intervention system. In FIG. 7, for example, another embodiment of the dynamic seal assembly 24 is illustrated and can be designed with these and other features. In the illustrated alternate embodiment, the dynamic seal assembly 24 is similarly conveyed to subsea installation 26 via conveyance 40. The conveyance 40 may comprise a wireline cable or a slickline. In other embodiments, conveyance 40 may comprise braided cable, coiled tubing, coiled rod, or other conveyance types suitable for subsea applications. The intervention tool string 38 and retrievable dynamic seal assembly 24 can be conveyed together through open waters in the case of riserless operations. In other applications, seal assembly 24 and tool string 38 can be deployed through tubular guides, including rigid risers, flexible risers, drill pipe, tubing, spoolable compliant guides, and other suitable tubulars connecting the subsea installation 26 with the surface vessel 28.

In the illustrated embodiment, retrievable dynamic seal assembly 24 is temporarily locked to intervention tool string 38 by a tool string lock mechanism 102. The lock mechanism 102 is mounted to a body 104 of retrievable dynamic seal assembly 24 and engages a corresponding attachment region 106 of tool string 38. By way of example, the lock mechanism 102 may comprise a plurality of tool catch fingers 108 designed to releasably engage attachment region 106. When lock mechanism 102 is engaged with attachment region 106, body 104 and retrievable dynamic seal assembly 24 cannot slide along conveyance 40 during descent towards the subsea installation 26.

As the dynamic seal assembly 24 reaches subsea installation 26, it is moved into a tubular structure 110 that may comprise a lubricating chamber 112. The seal assembly 24 is landed into a corresponding landing profile 114 and locked into place with a releasable locking mechanism 116. By way of example, the releasable locking mechanism 116 may comprise one or more locking fingers 118 positioned and designed to engage landing profile 114. Once sealing assembly 24 is locked into place with releasable locking mechanism 116, tool string lock mechanism 102 can be released to enable movement of tool string 38 into the subsea well 46 for a desired intervention operation.

When the retrievable dynamic seal assembly 24 lands in its seat/landing profile 114, dynamic seal 70 can be activated to form a seal between body 104 and conveyance 40. As illustrated, dynamic seal 70 comprises a compressible seal element 120 that may be selectively compressed via an activation piston 122 which forces the element 120 to sealingly engage conveyance 40. Activation piston 122 may be an electronically driven piston, a hydraulically driven piston, or other suitable pistons able to compress element 120 sufficiently to form a seal against conveyance 40.

In the embodiment illustrated, activation piston 122 comprises a hydraulically actuated piston controlled by appropriate control signals applied via a hydraulic activation circuit 124. For example, suitable hydraulic pressure may be applied against activation piston 122 via appropriate hydraulic passageways 126. The applied hydraulic pressure is contained by appropriately located seals. In this example, seals 128 are positioned between body 104 and tubular structure 110 on opposite sides of hydraulic activation circuit 124 and the corresponding hydraulic passageways 126. Additional seals 130 can be deployed between dynamic seal 70 and the surrounding interior surface of body 104. Applying hydraulic pressure to the fluid contained in hydraulic activation circuit 124 forces activation piston 122 in a direction that compresses compressible seal element 120. Compression of element 120 effectively activates the dynamic seal 70 and creates a seal against conveyance 40 to create a valid pressure bather which can hold differential pressure between the upper and lower sides of retrievable dynamic seal assembly 24. In some applications, the control signal applied by hydraulic activation circuit 124 is proportional to the differential pressure existing between regions above and below the retrievable dynamic seal assembly 24. In other or similar applications, viscous grease can be used in hydraulic activation circuit 124 to improve the sealing performance of compressible seal element 120 by extending its operating range to higher differential pressures and by helping form a valid seal in the presence of gas.

Creation of the seal with conveyance 40 enables deployment of tool string 38 into the subsea well 46 for performance of the desired intervention operation. This also allows lubricating chamber 112 to form a pressure containment region that enables opening of wellbore seal 100 for movement of the tool string downhole. Once the intervention operation is completed and the tool string 38 is ready for retrieval to the surface, the intervention tool string 38 is retrieved to lubricating chamber 112 and pulled up against body 104 of retrievable dynamic seal assembly 24.

The movement of attachment region 106 against seal assembly 24 causes tool string lock mechanism 102 to open and lock attachment region 106 to the retrievable dynamic seal assembly 24. A pressure equalization system also can be used in conjunction with the seal assembly 24 to equalize pressure above and below the retrievable dynamic seal assembly. Once the pressure is equalized, releasable locking mechanism 116 can be released from landing profile 114, and seal assembly 24 can be retrieved to the surface with the intervention tool string 38.

Use of activation piston 122 along with, for example, hydraulic activation circuit 124, enables dynamic seal assembly activation and de-activation independently of pressure in the subsea installation, pressure in the subsea environment, or differential pressure formed between those regions. Furthermore, retrievable dynamic seal assembly 24 can incorporate a variety of other features to facilitate appropriate action in a variety of downhole scenarios. For example, fishing neck 74 can be attached to body 104 to facilitate fishing operations, if necessary. Additionally, a valve assembly 132 can be positioned along a body passageway 134 through which conveyance 40 extends through body 104. Valve assembly 132 is able to pressure seal passageway 134 when conveyance 40 is not present in passageway 134. By way of example, valve assembly 132 may comprise a ball check valve able to seal against differential pressure in both directions. The retrievable dynamic seal assembly 24 also can incorporate one or more weak points 136 that break when a pre-established overpull is applied to conveyance 40. By breaking the weakened points 136, the dynamic seal assembly 24 can be retrieved to the surface even if releasable locking mechanism 116 and/or tool string lock mechanism 102 fail to release or function properly.

It should be noted that retrievable dynamic seal assembly 24 also may comprise a variety of actuation mechanisms for actuating releasable locking mechanism 116 and tool string lock mechanism 102. By way of example, conventional hydraulic, electric, e.g. solenoid, or other suitable actuation mechanisms can be used to selectively engage and disengage these locking mechanisms. A variety of actuation mechanisms are available and used in downhole applications. For example, such mechanisms are used in logging plug devices and other types of seal devices. The releasable locking mechanism 116 and/or tool string lock mechanism 102 also can be activated from outside the retrievable dynamic seal body 104 by, for example, appropriate hydraulic circuits, electric circuits, remotely operated vehicle activation, and other activation devices.

Figure 8:
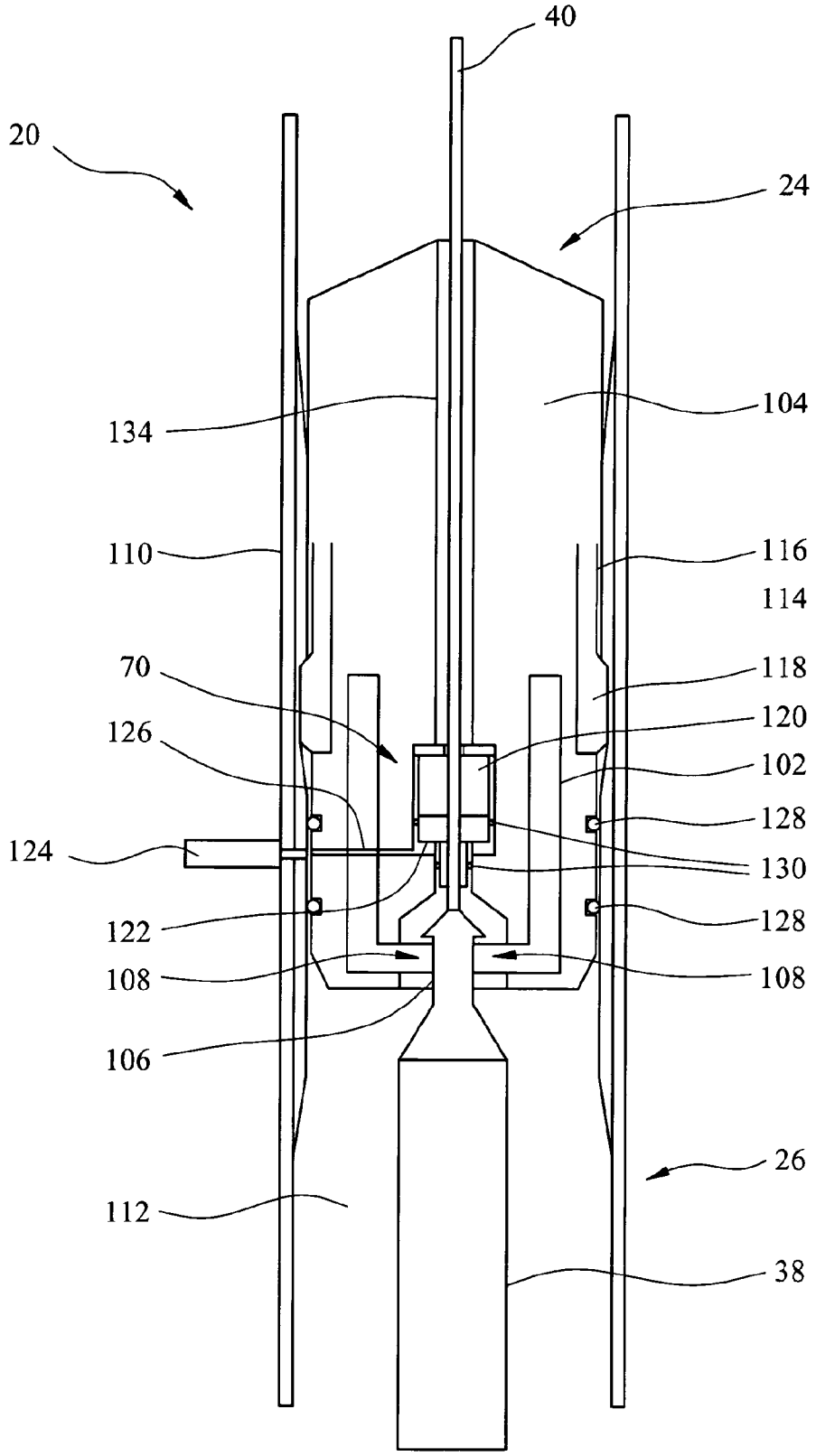
FIG. 8 is a schematic illustration similar to that of FIG. 7 but showing another alternate example of the retrievable dynamic seal assembly, according to an embodiment of the present invention.

In the embodiment illustrated in FIG. 7, dynamic seal 70 is located generally in an upper portion of body 104. However, the dynamic seal 70 can be positioned at other locations along passageway 134. In the embodiment illustrated in FIG. 8, for example, seal element 70 is positioned generally at a lower end of body 104 below locking fingers 118.

Figure 9:
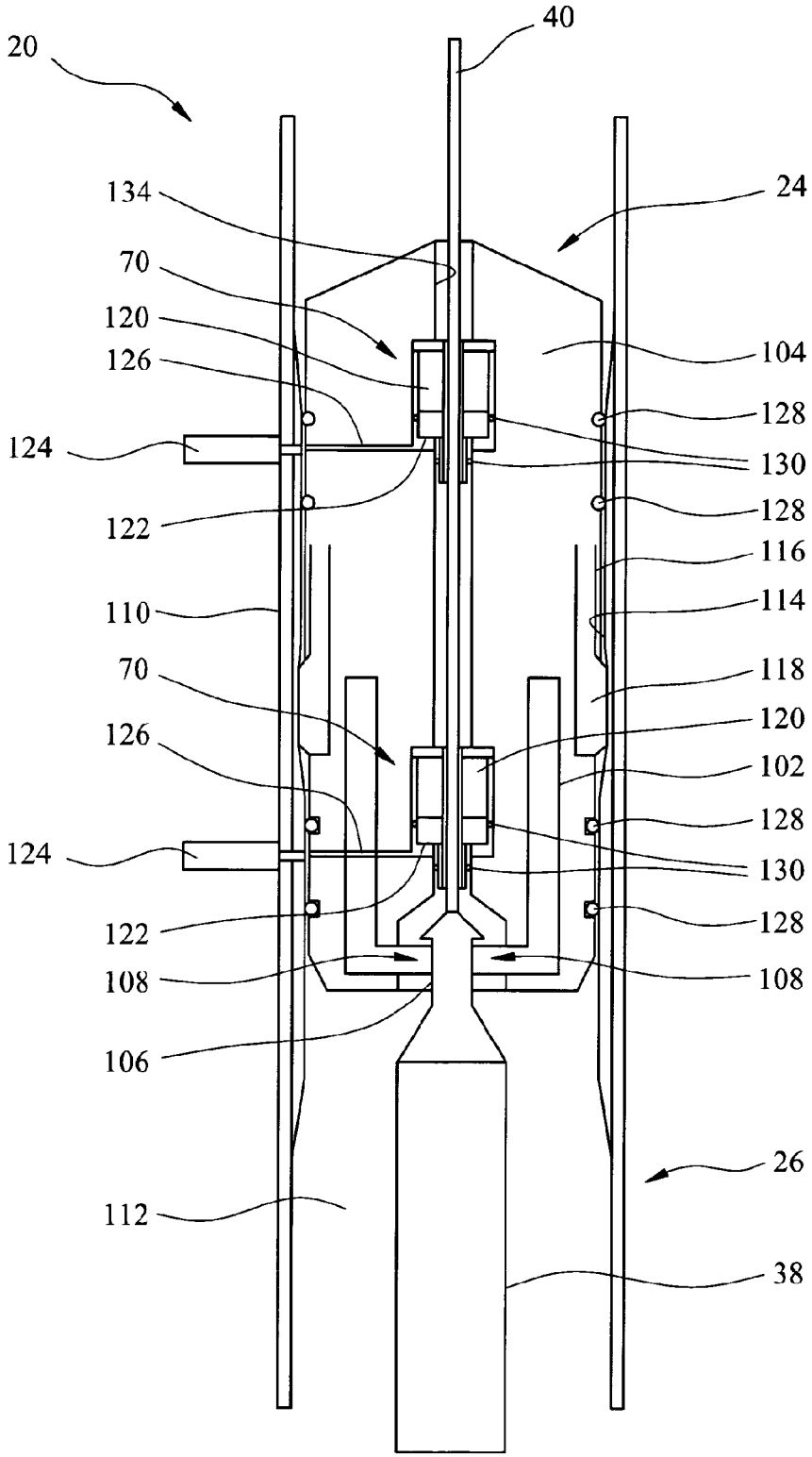
FIG. 9 is a schematic illustration similar to that of FIG. 7 but showing another alternate example of the retrievable dynamic seal assembly, according to an embodiment of the present invention.

Multiple dynamic seals 70 also can be used in the same dynamic seal assembly body 104. In the embodiment illustrated in FIG. 9, two dynamic seals 70 are embedded into the same retrievable dynamic seal body 104. Each dynamic seal 70 has its own hydraulic actuation circuit 124 and corresponding activation piston 122. The two or more dynamic seals 70 can be activated simultaneously, or they can be used independently. For example, one of the dynamic seals 70 can be used as a backup dynamic seal 70 that is activated only in case of failure with respect to the other dynamic seal.

Figure 10:
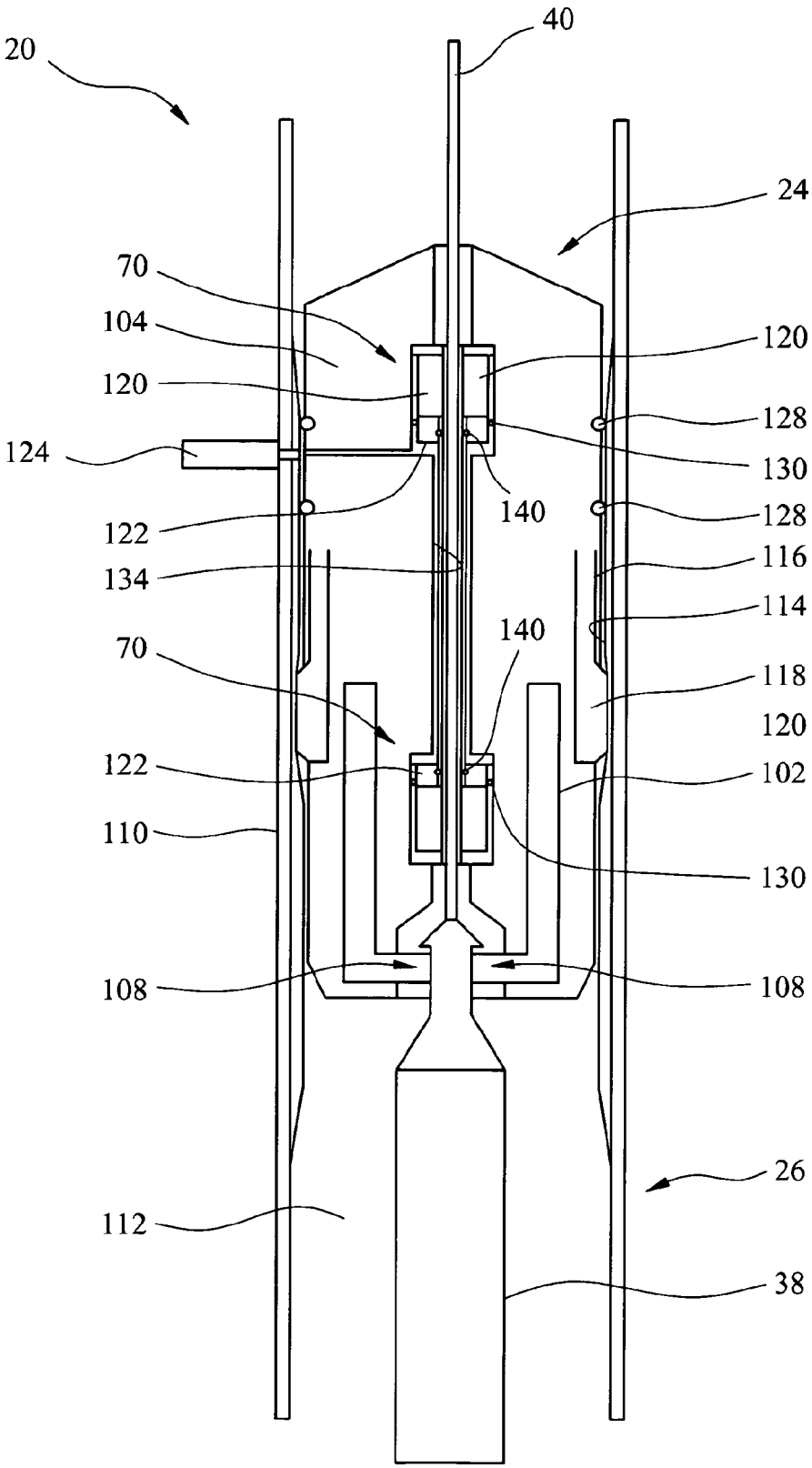
FIG. 10 is a schematic illustration similar to that of FIG. 7 but showing another alternate example of the retrievable dynamic seal assembly, according to an embodiment of the present invention.

Referring generally to FIG. 10, another embodiment of retrievable dynamic seal assembly 24 is illustrated. In this embodiment, a plurality of dynamic seals 70, e.g. two dynamic seals, are embedded in the same body 104. The dynamic seals are activated by the same hydraulic activation circuit 124 which supplies hydraulic fluid to a plurality, e.g. two, of the activation pistons 122. In the example illustrated, the lower dynamic seal 70 is reversed or upside down relative to the upper dynamic seal 70 and is activated from above rather than from below as in the previous embodiments.

A tubular sliding link 138 is coupled between activation pistons 122 and allows variation of the distance between the activation pistons 122. The variation in distance between the pistons 122 is facilitated by seals, such as a elastomeric seals 140, positioned between the ends of the sliding link 138 and the surrounding bodies of the activation pistons 122, as illustrated. The tubular sliding link of 138 contains the pressurized fluid during hydraulic activation of dynamic seals 70 by preventing the pressurized fluid from escaping along conveyance 40 between the activation pistons 122.

Figure 11:
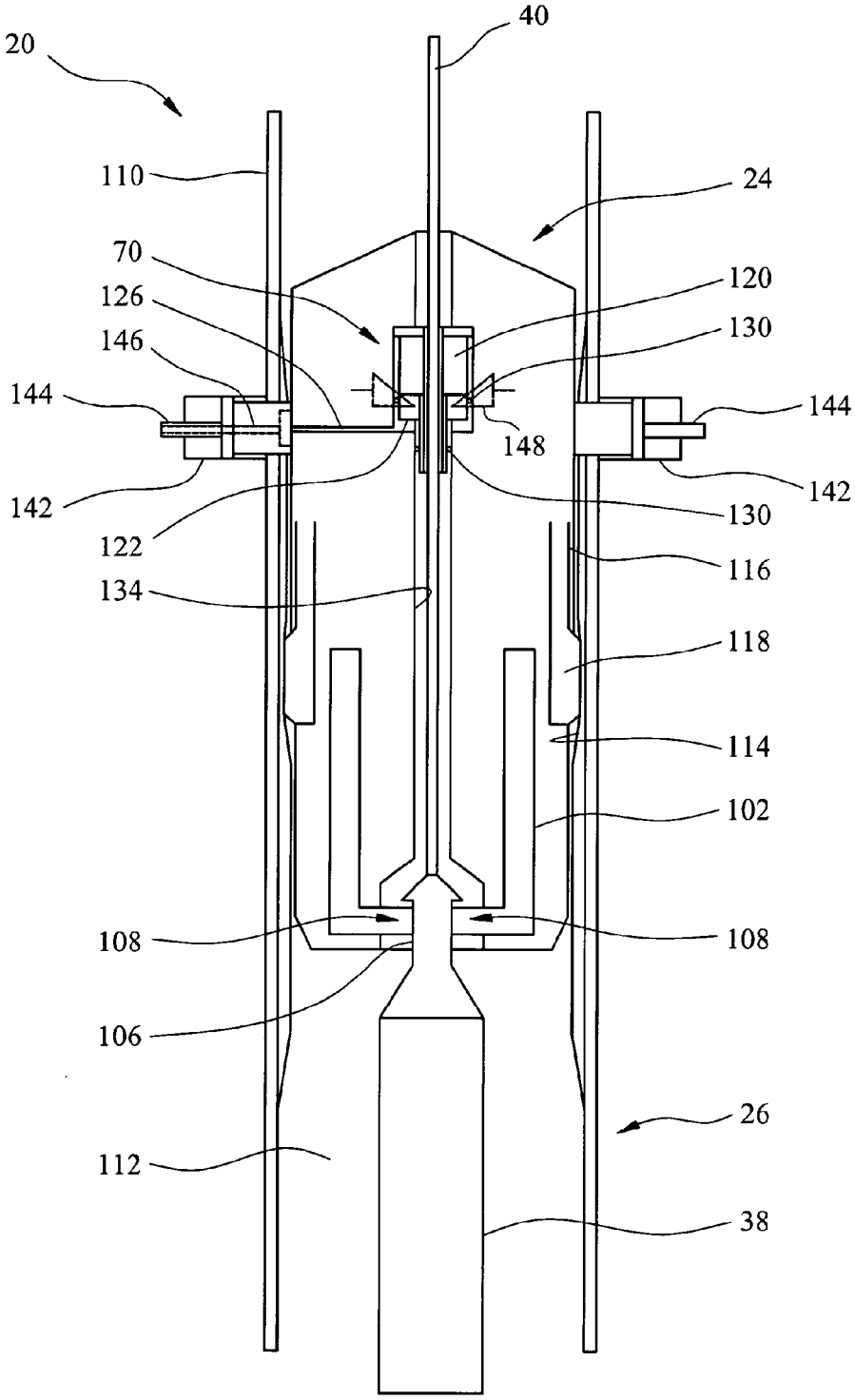
FIG. 11 is a schematic illustration similar to that of FIG. 7 but showing another alternate example of the retrievable dynamic seal assembly, according to an embodiment of the present invention.

Another embodiment of retrievable dynamic seal assembly 24 is illustrated in FIG. 11. In this embodiment, a single dynamic seal 70 has been integrated into an upper portion of body 104. By way of example, body 104 may be constructed generally in the form of a logging plug having dynamic seal 70 integrated within. In this configuration, a seal is formed between body 104 and the surrounding tubular structure 110 by a set of rams 142 that grab or press against body 104. The hydraulic fluid used to activate rams 142 via a fluid inlet 144 also can be used to activate dynamic seal 70. For example, a conduit 146 can be formed through one or more of the rams 142 for connection with hydraulic passageway 126 that supplies hydraulic fluid to activation piston 122.

It should be noted that other systems and mechanisms can be used to activate dynamic seal 70. For example, solenoids or other electrically actuated devices can be used to compress the compressible seal element 120. Additionally, the compression can be achieved by deploying sloped rams 148 (shown in dashed lines in FIG. 11) below and/or above compressible seal element 120. Movement of the sloped rams 148 against compressible seal element 120 squeezes the element until the seal element 120 seals against conveyance 40.

The embodiments described above can be utilized in many types of intervention operations. In one operational example, surface vessel 28 is moved into position generally over the subsea installation 26. The surface vessel 28 is used to convey intervention tool string 38 on conveyance 40. Additionally, the retrievable dynamic seal assembly 24 is releasably connected above the tool string 38 as the tool string and seal assembly are conveyed down to the subsea installation 26 on conveyance 40. Depending on the specific application, the tool string 38 and seal assembly 24 can be conveyed to subsea installation 26 through open water or through a tubular member, such as a riser or compliant guide.

When the intervention tool string 38 and retrievable dynamic seal assembly 24 reach the subsea installation 26, the seal assembly 24 is landed in a tubular structure, e.g. tubular structure 110. The tubular structure has a lubricating chamber to facilitate deployment of the tool string into a pressurized subsea installation. Once landed, the retrievable dynamic seal assembly is locked in place and the intervention tool string 38 is released. Additionally, one or more dynamic seals, e.g. dynamic seal 70, are activated to seal against conveyance 40 and to maintain a pressure barrier.

The pressure between the lubricating chamber and the subsea installation can be equalized to enable opening of the subsea installation, e.g. opening of wellbore seal 100, to the intervention tool string. The intervention tool string 38 is then conveyed into the subsea well 46, and the desired intervention operation is performed. Upon completion of the intervention operation, the tool string 38 is retrieved into the lubricating chamber, and the subsea installation 26 is closed. At this time, the lubricating chamber can be flushed, if necessary, with environmentally friendly fluid while bleeding off pressure. The intervention tool string 38 is then pulled against retrievable dynamic seal assembly 24 and locked to seal assembly 24 by tool string lock mechanism 102. Pressure can be equalized above and below the retrievable dynamic seal assembly, and locking mechanism 116 can be released for retrieval of the tool string 38 and seal assembly 24 to the surface.

Intervention system 20 and retrievable dynamic seal assembly 24 can be used in a variety of configurations, applications and environments. Additionally, the system 20 and seal assembly 24 can integrate or be used in cooperation with a variety of other components and features. For example, a remotely operated vehicle (ROV) can be used to activate the dynamic seals. Additionally, the retrievable dynamic seal assembly can be constructed in the general form of a stuffing box, such as a hydraulically activated stuffing box. Additionally, the tubular structure can include or be formed as a portion of a lubricator, a riser, a flexible riser, a spoolable compliant guide, a tubing, a drill pipe, a flow line, a jointed pipe, or another tubular structure formed as part of or connected to the subsea installation. The various components also can be used in cooperation to perform many intervention operations, including retrieving a plug from a subsea Christmas tree or installing a plug into a subsea Christmas tree.

Intervention system 20 facilitates deployment of many types of tool strings in a dependable and efficient manner. In many applications, the compliant guide 22 provides a protected environment through which dynamic seal 24 is readily transported to an operative position. The overall design enables use of a relatively simple dynamic seal while maintaining great system adaptability and providing an efficient way of deploying and retrieving intervention tool strings.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

The invention claimed is:

1. A system for subsea intervention operations, comprising:

a retrievable dynamic seal assembly, comprising:

a body;

a tool string lock mechanism coupled to the body at a location to releasably lock the retrievable dynamic seal assembly to a tool string;

a releasable locking mechanism positioned to lock the retrievable dynamic seal assembly in an operational position within a tubular structure at a subsea installation;

a dynamic seal having an actuator that enables selective actuation of the dynamic seal to seal against a conveyance coupled to the tool string; and a sealing mechanism positioned to form a seal between the body and the tubular.

2. The system as recited in claim 1, wherein the dynamic seal comprises a plurality of actuatable dynamic seals.

3. The system as recited in claim 1, wherein the dynamic seal is hydraulically actuated.

4. The system as recited in claim 1, wherein the releasable locking mechanism can be overridden with a pre-established overpull.

5. The system as recited in claim 1, wherein the body comprises a fishing neck portion.

6. The system as recited in claim 1, further comprising a valve positioned in the body to block flow through the dynamic seal if the conveyance is not present in the retrievable dynamic seal assembly.

7. The system as recited in claim 1, wherein activation and deactivation of the dynamic seal is accomplished independent of pressures in the subsea installation and the subsea environment.

8. A method of performing a subsea intervention operation, comprising:

providing a retrievable dynamic seal assembly comprising a body, a tool string lock mechanism, a releasable locking mechanism, and a dynamic seal;

releasably locking the retrievable dynamic seal assembly to a tool string with the tool string lock mechanism;

locking the retrievable dynamic seal assembly with the releasable locking mechanism in an operational position within a tubular structure at a subsea installation;

and selectively actuating the dynamic seal to seal against a conveyance coupled to the tool string and a sealing mechanism positioned to form a seal between the body and the tubular structure.

* * * * *